United States Patent [19]

Hefner, Jr.

[11] 4,172,029

[45] Oct. 23, 1979

[54] PHOSPHATE FLOTATION PROCESS

[75] Inventor: Robert E. Hefner, Jr., Midland, Mich.

[73] Assignee: The Dow Chemical Company, Midland, Mich.

[21] Appl. No.: 904,835

[22] Filed: May 11, 1978

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 1,709,477 | 4/1929 | Tinison | 209/166 X |
| 2,285,366 | 6/1942 | Shefheld | 209/166 X |
| 2,321,978 | 6/1943 | Burglin | 209/166 X |
| 2,442,455 | 6/1948 | Booth | 209/166 |
| 3,164,549 | 1/1965 | Seymour | 209/166 |
| 3,292,787 | 12/1966 | Fuerstenau | 209/166 |
| 3,405,802 | 10/1968 | Preller | 209/166 |
| 4,133,750 | 1/1979 | Burress | 209/166 |

FOREIGN PATENT DOCUMENTS

| | | | |
|---|---|---|---|
| 479719 | 5/1916 | France | 209/166 |
| 830589 | 1/1939 | France | 209/166 |
| 584206 | 1/1947 | United Kingdom | 209/166 |

*Primary Examiner*—Robert Halper

*Attorney, Agent, or Firm*—Michael L. Glenn

[57] ABSTRACT

In the flotation of phosphate ore slurries with fuel oil and a fatty acid, the addition of an aromatic polycyclic, hydrocarbon compound bearing a nuclear sulfonic acid or sulfonate moiety on each ring to the ore slurry prior to conditioning enhances the separation of phosphate from silica. Disulfonated biphenyl or diphenyl ether compounds and disulfonated or trisulfonated triphenyl diether, triphenyl or biphenylyl phenyl ether compounds, wherein the compound bears at least one nuclear alkyl group having from 12 to 22 carbon atoms, are particularly advantageous additives in a phosphate flotation process.

10 Claims, No Drawings

PHOSPHATE FLOTATION PROCESS

BACKGROUND OF THE INVENTION

This invention relates to an improved process for phosphate flotation. In particular, this invention relates to the use of sulfonated aromatic hydrocarbons in the flotation of phosphate with a fatty acid and fuel oil.

In the present day commercial beneficiation of siliceous phosphate ores, a deslimed and sized phosphate ore is conditioned with and then floated by a fatty acid collector and fuel oil reagent in an aerated aqueous solution at a pH of at least about 8. This flotation process produces a low-grade phosphate concentrate containing from about 50 to 65 weight percent bone phosphate of lime (BPL). Frequently, the low-grade concentrate from the aforementioned flotation is blunged with acid to remove collector coatings, deslimed and the phosphate is further concentrated by flotation of residual silica from the concentrate with an amine-derived reagent.

The above described process is effective in the recovery of BPL from phosphate ore, but there exists a need for increased recovery of phosphate values without diminuation of the weight percent BPL in the concentrate. This need is exacerbated by the diminishing reserves of high-grade phosphate ore. In view of the large quantities of phosphate rock processed by froth flotation, such a development can result in a substantial increase in total amount of phosphorous values recovered.

Further, the present flotation agents have a limited tolerance for calcium, magnesium and like ions, present in the typically "hard" water used in the flotation medium. There exists a need for flotation agents which can tolerate a greater degree of "hardness" in the flotation medium.

As is illustrated in numerous patents, those skilled in the art have long sought a method to enhance the separation of phosphate values from silica in the phosphate ore. U.S. Pat. No. 3,164,549 discloses that dodecyl benzene sulfonic acid or certain other alkyl aryl sulfonic acids can be employed as a collector in preference to tall oil in a phosphate flotation process. The alkyl aryl sulfonic acid reagent, used at a loading of from 0.1 to 2 pounds reagent per ton of feed material, is disclosed to eliminate the need for a second flotation step to remove additional amounts of silica.

U.S. Pat. No. 3,292,787 teaches a process for beneficiating phosphate ores by froth flotation utilizing an alkali metal salt of a hydrocarbon aromatic sulfonic acid and a hydrocarbon oil of a specified viscosity.

Also known to the art, are certain partial esters of a polycarboxylic acid disclosed in U.S. Pat. No. 4,034,863, which are operable phosphate flotation agents. However, the aforementioned patented flotation processes have not been of commercial value. The limited increased phosphate recovery effected by these processes is more than offset by the higher cost of the reagents relative to those used in the conventional process.

The practice of this invention is useful to increase the recovery of phosphate in a froth flotation process without substantial diminution of the selectivity of the flotation.

SUMMARY OF THE INVENTION

According to this invention, a process for beneficiating a siliceous phosphate ore by froth flotation with fatty acid and fuel oil reagents is improved by conditioning the phosphate ore in an aqueous slurry prior to aeration to float the phosphate with a sulfonated aromatic compound of the formula

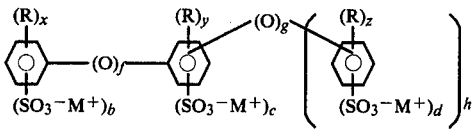

wherein x, y and z are individually integers of 0 to 2;

b, c and d are individually the integers 0 or 1 with the proviso that B+c+d is equal to at least 2;

each R is an alkyl radical and each R can be the same or different;

f, g and h are individually the integers 0 or 1 with the proviso that if h=0, then g=0; and $M^+$ is a hydrogen, alkali metal ion, alkaline earth metal ion or ammonium ion and each $M^+$ can be the same or different.

The central aryl radical

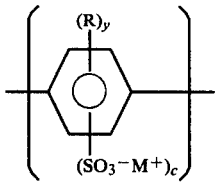

can bear the phenyl or phenoxide radicals with ortho, meta or para substitution.

DETAILED DESCRIPTION OF THE INVENTION

The aryl sulfonate utilized as a phosphate flotation additive in the practice of this invention is a biphenyl, triphenyl, diphenyl ether, biphenylyl phenyl ether, or triphenyl diether compound or mixture of such compounds bearing at least two nuclear sulfonic acid or sulfonate moieties. As used hereinafter, the term sulfonate refers to both sulfonic acid and ionic sulfonate moieties. Preferably, the aryl sulfonate bears one nuclear sulfonate moiety on each aromatic ring. The preferred additive is a disulfonated diphenyl ether.

The aryl sulfonate compounds described immediately above, and in particular disulfonated diphenyl ether, are operable as flotation additives. These additives improve the tolerance of conventional phosphate flotation agents for alkaline earth ions, which impart "hardness" to the aqueous flotation medium. This improved tolerance for hardness can be observed in aqueous mediums containing as little as about 20 milligrams of $CaCO_3$ equivalents per liter of water. However, preferably, the aryl sulfonate compound bears at least one alkyl radical having from 12 to 22, more preferably 16 to 18, carbon atoms. The alkyl radical can be branched, but it is more desirably linear. These preferred additives enhance the recovery of phosphate values even in deionized water without diminishing the weight percent BPL in the concentrate.

The identity of the radical corresponding to $M^+$ in the formula of the aryl sulfonate compound is not critical. Conveniently, this radical is sodium, potassium or an ammonium ion. The ammonium ion can be present as almost any ammonium ion which is not reactive with the other components present. For example, the aryl sulfonate can be a salt of methylamine, ethylamine, ethanolamine, dimethylamine and the like, but the salt of triethanolamine is particularly desirable. Although the aryl sulfonates demonstrate a high tolerance for calcium and other bivalent alkaline earth ions in the aqueous slurry, the radical corresponding to $M^+$ is desirably not calcium or these other ions.

The aryl sulfonate compounds described herein can be prepared, in general, by methods known to the art. In the preferred method, the aryl compound can be alkylated by reacting it with olefin in the presence of a Friedel-Crafts catalyst. The alkylated or an unalkylated aryl compound can be sulfonated by contact with sulfur trioxide dissolved in liquid sulfur dioxide. This contact is generally conducted in refluxing sulfur dioxide. The aforementioned method of sulfonation is preferred for biphenyl, triphenyl, biphenylyl phenyl ether and triphenyl diether compounds, because it produces the desired high degree of sulfonation when an excess of the sulfonating agent is used. U.S. Pat. No. 2,854,477 discloses a method of preparing alkyl diphenyl ether sulfonates. Alternatively, some of these compounds can be purchased commercially. For example, The Dow Chemical Company markets alkylated diphenyl ether sulfonates under the trademark of Dowfax® surfactants.

The phosphate to be beneficiated is desirably the so-called Florida phosphate, which is relatively free of carbonate impurities. However, the phosphate ore to be beneficiated can suitably contain calcium as well as other carbonate impurities. Typically, the phosphate ore is mined from deposits containing from 15 to 35 weight percent BPL, i.e., $Ca_3(PO_4)_2$. The mined ore is scrubbed and sized in a manner known to the art. Generally, a phosphate ore fraction passed by 35 mesh, but not passed through 200 mesh is the fraction amenable to floating by the disclosed process. However, some small benefit is achieved in the flotation of particles larger than 35 mesh.

The washed and sized ore is mixed with sufficient water to prepare an aqueous slurry having a solids concentration of from 68 to 76 weight percent solids, preferably from 70 to 76 percent solids. The aqueous phosphate ore slurry is then conditioned by any conventional mixing means which is capable of uniformly mixing slurries of this high concentration. For example, the conditioning means can operably be a vertical mixing tank with a cruciform impeller or it may be a horizontal rotary drum with flights for lifting the feed.

During or prior to conditioning, an anionic flotation reagent consisting essentially of a fatty acid, a fuel oil, a pH adjusting compound and an aryl sulfonate compound are introduced into the aqueous phosphate ore slurry so as to effect during conditioning intimate contact of these reagents with substantially all of the ore. The fatty acid can be selected from the group consisting of oleic acid, linoleic acid, tall oils, rosin, mixtures thereof, and other like materials commonly used in anionic flotation reagents. The fatty acid should be introduced in a ratio of from about 0.3 to about 2 pounds fatty acid per ton of ore.

The fuel oil can be selected from the group consisting of diesel oil, kerosene, Bunker C fuel oil, mixtures thereof and other like materials commonly used in anionic flotation reagents. The fuel oil can be introduced in a ratio from about 1:1 to about 8:1 by weight relative to the fatty acid.

The pH adjusting composition is utilized to adjust and maintain the pH of the phosphate slurry to a value from about 7.5 to about 10.5, preferably at least about 9. The pH adjusting composition is preferably sodium hydroxide. Other alkaline materials are operable, such as soda ash, lime, ammonia, potassium hydroxide, magnesium hydroxide and the like. Some of the aryl sulfonate compounds can also be used to slightly adjust the pH of the medium.

The aryl sulfonate compound introduced into the phosphate ore slurry is of the type previously described. This aryl sulfonate is introduced in a ratio preferably no greater than about 0.2, more preferably no greater than about 0.1, kilogram per metric ton of phosphate ore. Ratios greater than the foregoing preferred ratios are operable, particularly if the water in the flotation medium is relatively hard, but overfrothing frequently results making recovery of the product difficult. The aryl sulfonate is introduced in a ratio preferably no less than about 0.005, more preferably no less than about 0.02, kilogram per metric ton of phosphate ore. The optimum ratio of the aryl sulfonate to the phosphate ore depends on the hardness of water in the flotation medium, the concentrations of fatty acid and of fuel oil, as well as other factors, but typically a ratio in the range of about 0.03 to about 0.1 kilogram per metric ton of phosphate is most preferred.

The order in which the aforementioned reagents are introduced into the aqueous phosphate slurry is not necessarily critical. It is operable to add the aryl sulfonate to the slurry prior to, contemporaneous with or following the addition of the fatty acid and fuel oil. However, it is convenient to add the aryl sulfonate after the pH of the slurry is adjusted. In typical plant operation, several conditioning tanks connected in series, are used to provide proper retention time. Therefore, the above-identified reagents can be added in separate conditioning stages.

The conditioned phosphate ore slurry is then introduced into a flotation machine or bank of rougher cells where, typically after dilution, it is aerated to float the phosphate. Any suitable rougher flotation unit can be employed.

The practice of the method of the present invention can be used alone to beneficiate phosphate ore. Alternatively, the method can be used in conjunction with cationic flotations preceding or following the method to effect even greater beneficiation.

The following examples are illustrative embodiments of this invention. Unless otherwise indicated, all parts and percentages are by weight.

EXAMPLE 1

In a series of identical runs that differ only in the sulfonate additive, a 1000-gram charge of sized and deslimed phosphate rougher feed is diluted with deionized water to a slurry of 72 percent solids. The phosphate content in the feed varied in the runs from 27 to 32 weight percent BPL. An aqueous solution of 10 percent sodium hydroxide is used to adjust the slurry pH to about 9. The pH adjustment is repeated as necessary during the subsequent steps.

One part tall oil fatty acid, weighing 0.35 grams, is dissolved in three parts fuel oil. The tall oil solution is then added to the slurry. A sodium salt of diphenyl ether disulfonate is also added to the slurry (except in one instance which is used as a control). The slurry of phosphate ore is then conditioned by mixing for two minutes, while sodium hydroxide is added as necessary to maintain a pH of 9.

The conditioned phosphate ore slurry is introduced into a flotation machine (specifically, a Wemco Fagergren Mineral-Master machine), diluted with deionized water and further conditioned by a high rate of mixing for 30 seconds. The slurry is further diluted with deionized water to promote flotation. Flotation is initiated by aeration with mixing for two to three minutes. The floating concentrate is collected and the sequence of conditioning steps then flotation repeated twice more with the remaining medium.

The concentrate collected and the tail material are individually dewatered by 150 mesh screen and dried. Both the concentrate and tail fractions are analyzed for percent BPL by standard photometric methods.

Two separate runs (except in Run 8) are made with each sulfonate additive to indicate reproducibility. In Table I are tabulated the alkyl group on the sulfonated diphenyl ether. The additive can be a mixture of monoalkylated (one alkyl group per compound) and dialkylated (one alkyl group per ring) compounds. Table I also tabulates the loading of the sulfonate compound in kilograms per metric ton of phosphate ore and the BPL assay of the tail and concentrate. Because the BPL assay of the concentrate and tail is dependent on the assay of the ore, the weight distribution of phosphate in each of these fractions is also normalized and tabulated as a percentage of the total phosphate to provide indexes of the degree of separation effected.

TABLE I

| Run | Alkyl Group | Sulfonate (kg/ton) | Concentrate (% BPL) | Tail (% BPL) | Normalized Distribution BPL % Concentrate | % Tail |
|---|---|---|---|---|---|---|
| 1A* | — | none | 59.63 | 9.48 | 79.92 | 20.08 |
| 1B* | — | none | 62.35 | 9.51 | 80.85 | 19.15 |
| 2A | $C_{12}$ branched | 0.044 | 65.17 | 9.42 | 82.64 | 17.36 |
| 2B | $C_{12}$ branched | 0.044 | 67.56 | 10.30 | 80.84 | 19.17 |
| 3A | $C_{16}$ linear | 0.1 | 59.64 | 9.00 | 84.59 | 15.41 |
| 3B | $C_{16}$ linear | 0.1 | 57.82 | 10.95 | 79.70 | 20.30 |
| 4A | $C_{16}$ linear | 0.033 | 57.90 | 8.94 | 85.91 | 14.09 |
| 4B | $C_{16}$ linear | 0.033 | 63.95 | 9.59 | 82.69 | 17.31 |
| 5A | $C_{10}$ linear | 0.044 | 64.94 | 10.61 | 78.72 | 21.28 |
| 5B | $C_{10}$ linear | 0.044 | 62.70 | 10.73 | 78.77 | 21.24 |
| 6A | $C_{18}$ linear | 0.044 | 62.50 | 7.50 | 85.02 | 14.98 |
| 6B | $C_{18}$ linear | 0.044 | 58.31 | 10.10 | 83.01 | 17.00 |
| 7A | none | 0.044 | 59.47 | 10.51 | 82.28 | 17.72 |
| 7B | none | 0.044 | 57.94 | 8.65 | 84.63 | 15.37 |
| 8 | $C_6$ linear | 0.044 | 62.40 | 11.08 | 80.12 | 19.99 |

The data in Table I demonstrates that the degree of separation of phosphate from gangue effected by the known flotation of phosphate with fuel oil and fatty acid is enhanced by the addition of a sulfonated phenyl ether bearing a nuclear alkyl group having 12 to 18 carbon atoms. The addition of a nonalkylated sulfonated phenyl ether produces a similar enhancement of separation. The separation of phosphate based on the normalized distribution of BPL in the concentrate improves in the runs with the above identified additives (Runs A and B of 2, 3, 4, 6 and 7) by an average difference of from 1 to almost 4 percent over the prior art method depicted in Runs 1A and 1B. Runs 5A, 5B and 8 demonstrate that some sulfonated diphenyl ethers, which bear nuclear alkyl groups having 6 or 10 carbon atoms, do not enhance the separation of phosphate in a deionized water medium. However, it is noteworthy in these same runs (5A, 5B and 8) that the weight percent BPL in the concentrate is improved, which indicate some improvement in selectivity with these additives (i.e., less gangue floated), even if the recovery of phosphate values is not enhanced. The discrepancy in the normalized distribution of BPL between Runs 3A and 3B can be attributed to the excessive frothing during flotation at these high loadings in deionized water.

EXAMPLE 2

A series of identical runs, that differ only in the mixture of monoalkylated and dialkylated sodium salts of sulfonated diphenyl ether, are performed in the same manner as in Example 1. The alkyl group in all runs is a branched one having 12 carbon atoms.

In one pair of foltations the diphenyl ether sulfonate is 100 percent monoalkylated. In the other two pairs of flotations the sulfonates are mixed in ratios of monoalkylated to dialkylated compounds of 4:1 and 1:1 respectively. In all the flotations the sulfonate is present in a ratio of 0.044 kilogram per metric ton of ore. The relevant parameters are tabulated in Table II.

TABLE II

| Run | Alkylation (Mono:Di) | Concentrate (% BPL) | Tail (% BPL) | Normalized Distribution BPL % Concentrate | % Tail |
|---|---|---|---|---|---|
| 1A | 50:50 | 54.95 | 7.70 | 82.30 | 17.70 |
| 1B | " | 64.46 | 10.07 | 80.50 | 19.50 |
| 2A | 80:20 | 65.17 | 9.42 | 82.64 | 17.36 |
| 2B | " | 67.56 | 10.30 | 80.84 | 19.17 |
| 3A | 100:0 | 63.55 | 10.42 | 80.23 | 19.77 |
| 3B | " | 65.95 | 9.94 | 82.46 | 17.54 |

The data in Table II demonstrates that the degree of separation of phosphate from gangue is not greatly effected by whether the diphenyl ether sulfonate is monoalkylated or dialkylated.

EXAMPLE 3

Two sets of flotations using a sodium salt of a mixture of disulfonated and trisulfonated, monoalkylated triphenyl diether or a mixture of disulfonated and trisulfonated, monoalkylated biphenylyl phenyl ether are performed in the same manner as in Example 1. The alkyl group is a linear one having 18 carbon atoms. The sulfonate in the flotations is present in a ratio of 0.044 kilogram per metric ton of ore. The relevant parameters are tabulated in Table III, along with a control run with no sulfonate present for comparison.

TABLE III

| Run | Aryl Sulfonate | Concentrate (% BPL) | Tail (% BPL) | Normalized Distribution BPL % Concentrate | % Tail |
|---|---|---|---|---|---|
| 1A | Triphenyl diether | 60.89 | 8.20 | 85.24 | 14.77 |
| 1B | " | 60.37 | 8.49 | 85.07 | 14.93 |
| 2A | Biphenylyl phenyl ether | 64.66 | 9.57 | 83.60 | 16.40 |
| 2B | " | 65.39 | 10.75 | 81.27 | 18.73 |
| 3A* | None | 59.63 | 9.48 | 79.92 | 20.08 |
| 3B* | " | 62.35 | 9.51 | 80.85 | 19.15 |

*Not an embodiment of this invention.

The data in Table III demonstrates that alkylated, trisulfonated triphenyl diether and biphenylyl phenyl ether compounds also enhance the separation of phosphate.

COMPARATIVE EXAMPLE 4

A series of identical runs, that differ only in the alkyl aryl sulfonate additive, are performed in the same manner as in Example 1. In these runs, the additive is selected from dodecylbenzene sulfonic acid (DDBSA), dinonylnaphthalene disulfonic acid (DNNDSA) or a mixture of petroleum sulfonates sold commercially by Witco Chemical Company under the designation TRS 10-80. The foregoing additives represent the types of alkyl aryl sulfonate collectors for phosphate ore known in the prior art and are not embodiments of the claimed method. In all of the flotations deionized water is used and the sulfonate is present in the ratio of 0.044 kilogram per metric ton of phosphate ore. The relevant parameters in the aforementioned runs are tabulated in Table IV, along with a control run with no sulfonate present for comparison.

TABLE IV

| Run | Aryl Sulfonate | Concentrate (% BPL) | Tail (% BPL) | Normalized Distribution BPL Concentrate | % Tail |
|---|---|---|---|---|---|
| 1* | — | 62.35 | 9.51 | 80.85 | 19.15 |
| 2* | DDBSA | 65.13 | 10.61 | 80.13 | 19.87 |
| 3* | DNNDSA | 65.19 | 9.33 | 82.27 | 17.83 |
| 4* | TRS 10-80 | 62.98 | 9.61 | 82.46 | 17.54 |

*Not an embodiment of this invention.

It is apparent from the data tabulated in Table IV that DDBSA is not effective as an additive in phosphate flotation. While DNNSA and TRS 10-80 moderately enhance the separation of phosphate from the ore, these additives do not possess the activity, even in deionized water, of the preferred embodiments of this invention.

EXAMPLE 5

A series of flotation runs, that differ primarily in the alkyl aryl sulfonate additive, are performed in the same manner as in Example 1, except that calcium hydroxide in the amount of 0.01 weight percent of the phosphate ore is introduced into the deionized water prior to flotation. The presence of the calcium ions simulates the hard water conditions present in commercial flotation cells. In these runs, the alkyl aryl sulfonate additive is selected from a disodium salt of disulfonated diphenyl ether bearing at least one linear alkyl group having 16 carbon atoms or from a mixture of petroleum sulfonates sold commercially by Witco Chemical Company under the designation TRS 10-80. The flotation of phosphate in the presence of mixed petroleum sulfonates is not an embodiment of this invention. The relevant parameters in the aforementioned runs are tabulated in Table V, along with a control run with no sulfonate present for comparison.

TABLE V

| Run | Aryl Sulfonate | Sulfonate (kg/ton) | Concentrate (% BPL) | Tail (% BPL) | Normalized Distribution BPL % Concentrate | % Tail |
|---|---|---|---|---|---|---|
| 1* | — | none | 62.41 | 11.58 | 79.26 | 20.74 |
| 2* | TRS 10-80 | 0.044 | 64.05 | 11.80 | 79.66 | 20.34 |
| 3 | Diphenyl ether | 0.033 | 62.02 | 10.61 | 81.76 | 18.24 |
| 4 | Diphenyl ether | 0.10 | 59.98 | 8.87 | 85.98 | 14.03 |

*Not an embodiment of this invention.

The data in Table V demonstrates that the petroleum sulfonate collectors known to the prior art enhance the separation of phosphate from gangue to only a small degree in water containing calcium ions. Whereas, the salt of disulfonated diphenyl ether significantly enhances the separation of phosphate at relatively lower loadings.

What is claimed is:

1. In a process for beneficiating a siliceous phosphate ore by froth flotation, the process comprising the steps of conditioning an aqueous slurry of phosphate ore at a pH of from 7.5 to 10.5 with a fatty acid and a fuel oil and aerating the conditioned phosphate slurry to float the phosphate, the improvement comprising conditioning the aqueous phosphate slurry prior to aeration with a sulfonated aromatic compound of the formula

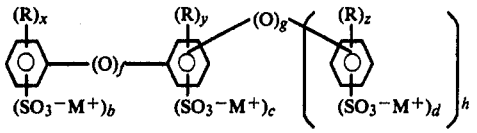

wherein x, y and z are individually integers of 0 to 2;

b, c and d are individually the integers 0 or 1 with the proviso that b+c+d is equal to at least 2;

each R is an alkyl radical and each R can be the same or different;

f, g and h are individually the integers 0 or 1 with the proviso that if h=0, then g=0; and $M^+$ is a hydrogen, alkali metal ion, alkaline earth metal ion or ammonium ion and each $M^+$ can be the same or different.

2. The improvement as described in claim 1 with the proviso that if $(x+y+z)\neq 0$, then at least one R must be an alkyl radical having from 12 to 22 carbon atoms.

3. The improvement as described in claim 2 wherein the aqueous phosphate slurry is conditioned with from about 0.03 to about 0.1 kilogram of the sulfonated aromatic compound per ton of phosphate ore.

4. The improvement as described in claim 3 wherein $M^+$ is a sodium, potassium or quaternary ammonium ion.

5. The improvement as described in claim 4 wherein x, y and z are individually the integers 0 or 1.

6. The improvement as described in claim 3 wherein f is the integer 1 and g and h are the same integer.

7. The improvement as described in claim 6 wherein g and h are the integer 0.

8. The improvement as described in claim 7 wherein x=1, y=0 or 1 and R is an alkyl radical having from 10 to 18 carbon atoms.

9. The improvement as described in claim 1 wherein the flotation is carried out in water containing alkaline earth ions in a concentration of at least about 20 milligram equivalents of $CaCO_3$ per liter of water.

10. The improvement as described in claims 1 or 2 wherein the aqueous phosphate slurry is conditioned with from about 0.02 to about 0.2 kilogram of the sulfonated aromatic compound per metric ton of phosphate ore.

* * * * *

UNITED STATES PATENT AND TRADEMARK OFFICE

CERTIFICATE OF CORRECTION

PATENT NO. : 4,172,029

DATED : October 23, 1979

INVENTOR(S) : Robert E. Hefner, Jr.

It is certified that error appears in the above-identified patent and that said Letters Patent are hereby corrected as shown below:

Col. 2, line 20, "B+c+d" should read -- b+c+d --.

Col. 5, line 57, immediately below Table I, please add -- *Not an embodiment of this invention --.

Col. 6, line 22, "foltations" should read -- flotations --.

Col. 7, line 56, in the fifth column of Table IV, "Concentrate" should read -- % Concentrate --.

Signed and Sealed this

*Nineteenth* Day of *February 1980*

[SEAL]

*Attest:*

SIDNEY A. DIAMOND

*Attesting Officer*

*Commissioner of Patents and Trademarks*